US011959290B2

(12) United States Patent
Grey

(10) Patent No.: US 11,959,290 B2
(45) Date of Patent: Apr. 16, 2024

(54) SUPPORT FRAME AND METHOD OF USE

(71) Applicant: John Arthur Grey, Tamborine (AU)

(72) Inventor: John Arthur Grey, Tamborine (AU)

( * ) Notice: Subject to any disclaimer, the term of this patent is extended or adjusted under 35 U.S.C. 154(b) by 441 days.

(21) Appl. No.: 17/294,884

(22) PCT Filed: Nov. 25, 2019

(86) PCT No.: PCT/AU2019/051291

§ 371 (c)(1),
(2) Date: May 18, 2021

(87) PCT Pub. No.: WO2020/107062

PCT Pub. Date: Jun. 4, 2020

(65) Prior Publication Data

US 2022/0010571 A1 Jan. 13, 2022

(30) Foreign Application Priority Data

Nov. 29, 2018 (AU) ..... 2018904546

(51) Int. Cl.
*E04G 21/32* (2006.01)

(52) U.S. Cl.
CPC ..... *E04G 21/3214* (2013.01)

(58) Field of Classification Search
CPC . E04G 21/32; E04G 21/3204; E04G 21/3214; E04G 21/3223; E04G 21/3233
See application file for complete search history.

(56) References Cited

U.S. PATENT DOCUMENTS 3,084,759 A * 4/1963 Squire ..... E04G 21/3233 256/65.14
3,480,257 A * 11/1969 Bourn ..... E04G 5/045 182/113
3,883,106 A * 5/1975 Simonsen ..... E04G 25/08 248/200.1
3,980,278 A * 9/1976 Elias ..... E04G 21/3233 256/59
5,031,724 A * 7/1991 Quinn ..... E04G 25/065 182/186.6
5,297,779 A * 3/1994 Collins, Jr. ..... B66F 3/08 254/98

(Continued)

FOREIGN PATENT DOCUMENTS

DE 4336200 A1 * 4/1995 ..... B25B 5/102
EP 0390098 A1 * 10/1990

(Continued)

*Primary Examiner* — Jonathan P Masinick
(74) *Attorney, Agent, or Firm* — Weisun Rao; Jun Chen; Venture Partner, LLC

(57) ABSTRACT

The present invention relates to a support frame for use with an edge protection system for elevated structures, such as building rooves. The support frame includes a first frame portion and a second frame portion mounted together so as to be axially slidable relative one another between an extended position for locating a post of the edge protection system alongside a roof edge of a building and a retracted position. The support frame further includes a coupling mount extending from an uppermost frame member for coupling to a portion of the building adjacent the roof edge and for receiving and supporting the post in an upright position alongside the roof edge of the building.

19 Claims, 4 Drawing Sheets

(56) References Cited

U.S. PATENT DOCUMENTS

| | | | | | |
|---|---|---|---|---|---|
| 5,551,669 | A * | 9/1996 | Reinklou | ..... | E04G 21/3223 182/113 |
| 6,276,668 | B1 * | 8/2001 | Sweeley | ..... | E04G 21/3223 256/DIG. 6 |
| 6,679,482 | B2 * | 1/2004 | Allenbaugh | ..... | E04G 21/3242 248/231.71 |
| 7,273,200 | B2 | 9/2007 | Funes Gavilan | | |
| 7,510,152 | B2 * | 3/2009 | Melic | ..... | E04G 21/3233 211/105.6 |
| 10,947,732 | B2 * | 3/2021 | Rabin | ..... | E04D 13/0335 |

FOREIGN PATENT DOCUMENTS

| | | | | | |
|---|---|---|---|---|---|
| EP | 2578774 | A2 * | 4/2013 | ..... | E04G 21/243 |
| EP | 2698486 | B1 | 11/2016 | | |
| FR | 3000123 | A1 | 6/2014 | | |
| GB | 2303870 | A * | 3/1997 | ..... | E04G 1/15 |
| GB | 2412941 | A * | 10/2005 | ..... | E04G 1/153 |
| NL | 1007322 | C1 * | 4/1999 | | |

* cited by examiner

SUPPORT FRAME AND METHOD OF USE

CROSS-REFERENCE TO RELATED APPLICATIONS

This application is the US national phase of International Application No. PCT/AU2019/051291, filed on Nov. 25, 2019, which claims priority to Australian Application No. 2018904546, filed on Nov. 29, 2018, the contents of which are incorporated herein by reference in their entirety.

TECHNICAL FIELD

The present invention relates to a support frame for use with an edge protection system for elevated structures and a method of installing same.

BACKGROUND

Occupational health and safety regulations generally require the fitting of a temporary edge protection system or barrier around an upper edge of an elevated structure, such as, e.g., a building roof, to prevent a worker from falling from the structure.

Such a system or barrier usually includes guard rails mounted around an upper perimeter of the elevated structure to provide a temporary barrier should a worker slip or otherwise fall while working atop the structure. The guard rails are typically mounted to a series of substantially upright brackets or posts attached to and spaced along the upper perimeter of the elevated structure.

The brackets or posts typically take the form of lengths of tubular steel having a bracket portion for attachment to the structure. Accordingly, their weight makes them unwieldly and thus difficult and dangerous to install and dismantle, particularly when on a ladder or, worse yet, atop the elevated structure without an edge protection system or barrier in place.

Moreover, in some forms, the brackets or posts can include multiple components and thus be unnecessarily complicated and fiddly to install and dismantle, again all while either perched on a ladder or atop the elevated structure without an edge protection system or barrier in place.

SUMMARY OF INVENTION

Embodiments of the present invention provide a support frame for use with an edge protection system, an edge protection system including the support frame and a method of installing same, which may at least partially overcome at least one of the abovementioned disadvantages or provide the consumer with a useful or commercial choice.

According to a first aspect of the present invention, there is provided a support frame for an edge protection system, said frame including:

- a first frame member and a second frame member mounted together so as to be axially slidable relative to one another between an extended position for locating a post of the edge protection system alongside a roof edge of a building and a retracted position; and
- a coupling mount extending from an uppermost said frame member for coupling to a portion of the building and for receiving and supporting the post in an upright position alongside the roof edge of the building.

According to a second aspect of the present invention, there is provided an edge protection system including:

- at least two support frames each as defined in the first aspect;
- at least two posts, each configured to be supported by one of said at least two support frames; and
- at least one rail configured to span between the at least two posts.

Advantageously, the support frame of the present invention is light-weight and able to be readily installed and dismantled about a perimeter of a building without the need for an operator to be atop a roof of the building. Moreover, the sliding arrangement of the frame members between the extended and retracted positions enables the support frame to be rapidly erected and coupled to a portion of the building without the need for complicated fasteners and mounting mechanisms.

As indicated above, the support frame and edge protection system are for use in providing a temporary barrier around a roof edge of a building, preferably a one, two, or three-story building. A person skilled in the art, however, will appreciate that the support frame and edge protection system may ultimately be used with other elevated structures, such as, e.g., an elevated walkway, a balcony, a deck or a lookout.

The support frame may be of any suitable size, shape and construction for extending upright from a support surface, such as, e.g., a ground surface, to a roof edge of a building. Likewise, the support frame may be formed from any suitable durable, strong and yet light-weight material or materials. Typically, the support frame may be formed from metal material or materials, preferably aluminium.

Each frame member may include a pair of opposed ends, including a lower end and an opposed upper end when the support frame is in an upright position. Each frame member may extend longitudinally between the opposed ends, preferably in a linear direction.

The opposed ends of each frame member may be open or closed ends.

Each frame member may be constructed by any suitable means. For example, the frame members may be machine folded from sheet metal or may be an extrusion, preferably the latter.

The frame members may be tubular or of solid construction, preferably tubular with a substantially rectangular cross section. Preferably, each frame member may include an internal passage extending between the opposed ends.

Each frame member may typically include at least four sidewalls extending longitudinally between the opposed ends. The sidewalls may be substantially planar or curved. Likewise, each frame member may include at least four corners each extending between adjacent sidewalls. In some embodiments, one or more of the corners may be rounded or chamfered.

The frame members may be of any suitable length to together when arranged in series in the extended position span a height between the support surface and the roof edge of a building. For example, the frame members may each have a length of about 500 mm, about 550 mm, about 600 mm, about 650 mm, about 700 mm, about 750 mm, about 800 mm, about 850 mm, about 900 mm, about 950 mm, about 1,000 mm, about 1,050 mm, about 1,100 mm, about 1,150 mm, about 1,200 mm, about 1,250 mm, about 1,300 mm, about 1,350 mm, about 1,400 mm, about 1,450 mm, about 1,500 mm, about 1,550 mm, about 1,600 mm, about 1,650 mm, about 1,700 mm, about 1,750 mm, about 1,800 mm, about 1,850 mm, about 1,900 m, about 1,950 mm, or even about 2,000 mm or more.

In some embodiments, the frame members may be of substantially equal lengths. In other embodiments, the frame members may be of differing lengths.

The first and second frame members may be mounted together in any suitable way so as to be axially slidable relative to one another between the extended and retracted positions, typically in series or an end-to-end-like arrangement.

When mounted together and in an upright position, the first frame member may be an uppermost frame member and the second frame member may be a lowermost frame member.

In some embodiments, the first frame member may be slidably connected to a shaped groove or channel extending linearly at least partially along a length of the second frame member, preferably from an upper end at least partially towards the opposed lower end. The first frame member may further include at least one retaining member retainable and slidable within the shaped groove or channel such that the first frame member is able to slide along the shaped groove or channel but is prevented from separating away from the shaped groove or channel.

Conversely, in other embodiments, the second frame member may be slidably connected to a shaped groove or channel extending linearly at least partially along a length of the first frame member, preferably from a lower end at least partially towards the opposed upper end. The second frame member may likewise include at least one retaining member retainable and slidable within the shaped groove or channel such that the second frame member is able to slide along the shaped groove or channel but is prevented from separating away from the shaped groove or channel.

Typically, in such embodiments, the at least one retaining member may include an enlarged head or other type of retaining end configured to engage and be retained within the shaped groove or channel and be slidable relative to the shaped groove or channel.

Generally, in such embodiments, the shaped groove or channel may be defined in a sidewall of one frame member and the at least one retaining member may be a protrusion or projection extending outwardly from a sidewall of the other frame member.

In further such embodiments, one of the first and second frame members may include at least one or more of wheels, rollers, plain bearing pads or the like to facilitate sliding of the first and second frame members relative to one another between the extended and retracted positions.

In other embodiments, the first and second frame members may be mounted together in a telescopic arrangement in which one of the first and second frame members may be at least partially received within an end of the other of the first and second frame members and the one of the first and second frame members may be axially slidable relative to the other of the first and second frame members between the extended and retracted positions.

In preferred embodiments, the second frame member may be at least partially received in the lower end of the first frame member and may be axially slidable relative to the first frame member between the extended upright and retracted positions.

In some such embodiments, the first frame member may include one or more inwardly protruding rails or projections longitudinally extending at least partway along an internal surface of one or more walls and the second frame member may include one or more grooves or channels longitudinally extending at least partway along an outer surface of one or more corresponding walls and configured to engage with and at least partially receive the one or more inwardly protruding rails or projections when the second frame member is slidably at least partially received in the lower end of the first frame member. Advantageously, the rails or projections and corresponding grooves or channels may together enhance the strength of the frame members, particularly when under load.

The first and second frame members may be axially moved relative to one another in any suitable way. For example, in some embodiments, the frame members may be manually moved between positions and secured in place. In other embodiments, the support frame may include an actuating mechanism for moving the first and second frame members between the extended and retracted positions.

Any suitable type of actuating mechanism may be used. The actuating mechanism may be manually actuated or by using a drive. Movement may be linear, although non-linear movement, such as rotary movement, is also envisaged.

In some embodiments, the support frame may include a linear actuator operatively associated with the support frame for axially sliding the frame members relative to one another between the extended and retracted positions. The linear actuator may be a pneumatic or hydraulic ram, for example. Conversely, the linear actuator may be a servomotor or stepper motor. In some embodiments, the linear actuator may be a rigid chain actuator (also known as a linear chain actuator, a push-pull chain actuator, an electric chain actuator, a zip chain actuator or a column forming actuator). In yet other embodiments, the linear actuator may be a manually or electrically powered screw jack or screw actuator.

In some such embodiments, the support frame may include a hydraulic or pneumatic ram located within one of the first frame member and the second frame member for sliding the other of the first frame member and the second frame member relative to the one of the first frame member and the second frame member.

In preferred embodiments, the support frame may include a threaded shaft rotatably coupled to the first frame member and upon which the second frame member may be mounted for movement therealong by rotation of the threaded shaft between the extended and retracted positions, preferably in a linear direction.

The threaded shaft may be of any suitable size, shape and construction and formed from any suitable material or materials, typically metal, preferably steel.

Generally, the threaded shaft may include a pair of opposed ends, including a lower end and an opposed upper end when in an upright position. The shaft may extend longitudinally in a linear direction between opposed ends.

The threaded shaft may be of any suitable length. Typically, the threaded shaft may be longer than either of the first or second frame members so as to be able to move the frame members between the extended and retracted positions. For example, the threaded shaft may have a length of about 600 mm, about 650 mm, about 700 mm, about 750 mm, about 800 mm, about 900 mm, about 950 mm, about 1,000 mm, about 1,050 mm, about 1,100 mm, about 1,150 mm, about 1,200 mm, about 1,250 mm, about 1,300 mm, about 1,350 mm, about 1,400 mm, about 1,450 mm, about 1,500 mm, about 1,550 mm, about 1,600 mm, about 1,650 mm, about 1,700 mm, about 1,750 mm, about 1,800 mm, about 1,850 mm, about 1,900 m, about 1,950 mm, about 2,000 mm, about 2,050 mm, about 2,100 mm, about 2,150 mm, about 2,200 mm, about 2,250 mm, about 2,300 mm, about 2,350 mm, about 2,400 mm, about 2,450 mm or even about 2,500 mm or more.

The threaded shaft may preferably include an external thread extending at least partially along a length of the threaded shaft. The external thread may have any suitable thread profile, such as, e.g., square, triangular, trapezoidal or other shapes. Typically, the threaded shaft may have a screw thread profile with trapezoidal outlines, preferably an Acme thread form or trapezoidal metric thread form.

The threaded shaft may be rotatably coupled to or near the upper end of the first frame member and may extend along and through the internal passage of the first frame member and at least partially along the internal passage of the second frame member.

The upper end of the threaded shaft may be rotatably coupled to or near the upper end of the first frame member in any suitable way that allows rotation of the threaded shaft about its longitudinal axis. For example, the threaded shaft may be directly or indirectly coupled to the upper end of the first frame member.

In some embodiments, the upper end of the threaded shaft may be rotatably coupled to the upper end of the first frame member by way of a coupling mount. The coupling mount may include bearings to facilitate rotation of the threaded shaft relative to the coupling mount and the upper end of the first frame member.

In other such embodiments, the upper end of the threaded shaft may include a cog or gear configured to mesh with one or more gear or cog wheels arranged within the coupling mount. Typically, each gear or cog wheel may be rotatably mounted within the coupling mount.

In yet other such embodiments, the coupling mount may include a rotational inner cylindrical portion, a non-rotational outer portion and at least one bridging component at least partially disposed between the inner portion and the outer portion to at least partially facilitate rotation of the inner cylindrical portion relative to the outer portion. The inner cylindrical portion may be connectable to the upper end of the threaded shaft and the outer portion may be connectable to the upper end of the first frame member. The bridging component may typically include one or more bearings or gears, the latter configured to mesh with one or more gear or cog wheels rotatably coupled to the outer portion.

In other embodiments, the upper end of the first frame member may be substantially closed and include an opening sized and shaped for receiving the upper end of the threaded shaft therethrough. In such embodiments, the upper end of the threaded shaft may include an enlarged head sized and shaped such that it may not pass through the opening but may abut against an outer upper end of the first frame member, preferably via a washer.

In some such embodiments, the head may have a particular shape for engaging with a tool or a power tool, such as, e.g., a wrench or impact wrench for applying torque to the threaded shaft and turning or rotating the shaft relative to the frame members. For example, the head may have a non-circular shape, such as, e.g., a triangular, square, pentagonal, hexagonal or the like type head shape.

In other such embodiments, the head may include a tool engaging formation, such as, e.g., a socket, formed in the head for receiving a tool for applying torque to the threaded shaft and turning or rotating the shaft relative to the frame members. For example, the head may include a hex socket formed in the head.

As indicated above, the second frame member may be mounted to the threaded shaft for movement therealong by rotation of the threaded shaft between the extended and retracted positions, preferably threadingly mounted.

The second frame member may be threadingly mounted to the threaded shaft in any suitable way.

For example, in some embodiments, the second frame member may have a closed upper end including an opening with an internal thread sized and shaped for receiving the threaded shaft therethrough and for threadingly engaging with the external thread extending along the threaded shaft.

In other embodiments, the second frame member may include a screw mounting portion located within its internal passage for likewise receiving the threaded shaft therethrough and for threadingly engaging with the threaded shaft.

In some such embodiments, the screw mounting portion may include an opening with an internal thread sized and shaped for receiving the threaded shaft therethrough and for threadingly engaging with the external thread extending along the threaded shaft.

In other such embodiments, the screw mounting portion may include a nut and a nut holder for holding the nut. The nut holder may typically include a pair of opposed side walls between which the nut is secured and held in alignment for receiving the threaded shaft therethrough. The nut may preferably include an internal thread for threadingly engaging with the threaded shaft.

As indicated, the support frame includes the coupling mount extending from the uppermost frame member, preferably the first frame member. The coupling mount may be of any suitable size, shape and construction for coupling with a portion of the building and for receiving and supporting a post of an edge protection system in an upright position alongside the roof edge of the building. Generally, the coupling mount may couple with any suitable portion of the building adjacent or under the roof edge, such as, e.g., a fascia, a soffit beam, a rafter, a truss or any other like structural frame member of the building.

In some embodiments, the coupling mount may include a flanged portion configured to be fastened to a portion of the building. The flanged portion may include one or more openings each configured to receive a mechanical fastener therethrough for fastening the flanged portion to the portion of the building, preferably a fascia.

In other embodiments, the coupling mount may include a connecting mechanism or part of a connecting mechanism for coupling to a portion of the building. The connecting mechanism may include a first part associated with the coupling mount and a second part connectable to the first part and associated with the portion of the building. The connecting mechanism or parts of the connecting mechanism may or may not be of integral formation with the coupling mount and/or the portion of the building.

The parts of the connecting mechanism may include mateable male and female formations that couple together, including a threaded connection, an interference fit (snap fit) connection, a bayonet-type connection or a hook-and-loop type connection, for example.

In some such embodiments, the first part of the connecting mechanism associated with the coupling mount may include a male formation configured to be inserted into or coupled with a female formation of the second part of the connecting mechanism associated with the portion of the building. Conversely, in other such embodiments, the first part of the connecting mechanism associated with the coupling mount may include a female formation configured to at least partially receive or couple with a male formation of the second part of the connecting mechanism associated with the portion of the building.

In yet other embodiments, the coupling mount may include a pair of engagement members and at least one coupling mount frame member extending outwardly from a side of the first frame member, preferably in a perpendicular direction relative to a longitudinal axis of the first frame member, more preferably from an upper portion of the first frame member.

The coupling mount frame member may include a pair of opposed ends, including an inner end extending from a side of the first frame member and an opposed outer end. The frame member may extend longitudinally between the opposed ends, preferably in a linear direction.

Like the other frame members, the at least one coupling mount frame member may be of tubular construction with a substantially rectangular cross section. The coupling mount frame member and the first frame member may be permanently joined together using conventional welding techniques.

The pair of engagement members may be arranged on an outer end of the coupling mount frame member for engaging with a portion of the building, preferably a structural frame member, more preferably a fascia of the building.

The pair of engagement members may preferably be arranged in a spaced arrangement on the outer end of the coupling mount frame member for at least partially receiving and coupling with the portion of the building received therebetween, typically a lower edge of the fascia or another like structural frame member.

Each engagement member may be in the form of a projection extending upwardly from and at least partially across an upper surface of the coupling mount frame member in a lateral direction perpendicular to a longitudinal axis of the frame member.

In some embodiments, the coupling mount may include at least two coupling mount frame members. For example, the coupling mount may include a first coupling mount frame member as described above and a second coupling mount frame member extending at an angle between a lower portion of the first frame member and an outer portion of the first coupling mount frame member for supporting or bracing the first coupling mount frame member.

As indicated, the coupling mount is also configured for receiving and supporting a post of an edge protection system in an upright position alongside the roof edge of a building.

Generally, the coupling mount may include a post mount or socket for receiving at least a lower end of the post, preferably snugly receiving. The mount or socket may be of any suitable size, shape and construction known in the art for receiving and supporting a post.

Typically, the post mount or socket may be located at or near an inner end of the at least one coupling mount frame member.

In some embodiments, the post mount or socket may be configured to receive and mount the post in an upright position extending substantially parallel with a longitudinal axis the support frame. In other embodiments, the post mount or socket may be configured to receive and mount the post at an angle extending diagonally outwards from the roof edge of the building and a vertical plane of the support frame.

In some embodiments, the support frame may further include a base for at least partially stabilising the support frame in an upright position atop the support surface. The base may be of any suitable size, shape and construction and may be formed from any suitable material or materials.

For example, in some embodiments, the base may be formed from concrete, rubber and/or plastic material or materials.

The base may typically be in the form of a plate or block having a substantially polygonal shape. The base may have opposed surfaces extending substantially parallel to one another, including a lower surface and an opposed upper surface. The opposed surfaces may be interconnected by opposing edges, including an opposed end edges and opposed side edges.

In some embodiments, the base may be configured to be fastened to a support surface. For example, the base may include one or more openings extending through the opposed surfaces for receiving one or more mechanical fasteners therethrough.

In other embodiments, the lower surface of the base may include a grip surface or one or more gripping protrusions for, in use, at least partially engaging with the support surface.

The support frame may connect or couple with the base in any suitable way in order to support the support frame in an upright position relative to the support surface.

In some embodiments, the base may include a socket for at least partially receiving a lower end of the support frame, preferably snugly receiving a lower end of the second frame member.

In other embodiments, the base may include a mounting portion extending upwardly from the base. The mounting portion may be sized and shaped to be at least partially received in a lower end of the support frame, preferably snugly received in the lower end of the second frame member.

In yet other embodiments, the base and the support frame may connect together by a connecting mechanism or part of a connecting mechanism.

The connecting mechanism may include a first part associated with the base and a second part connectable to the first part and associated with the lower end of the support frame. The connecting mechanism or parts of the connecting mechanism may or may not be of integral formation with the base and/or the lower end of the support frame.

The parts of the connecting mechanism may include mateable male and female formations that couple together, including a threaded connection, an interference fit (snap fit) connection, a bayonet-type connection or a hook-and-loop type connection, for example.

In some such embodiments, the first part of the connecting mechanism associated with the base may include a male formation configured to be inserted into or coupled with a female formation of the second part of the connecting mechanism associated with the lower end of the support frame. Conversely, in other such embodiments, the first part of the connecting mechanism associated with the base may include a female formation configured to at least partially receive or couple with a male formation of the second part of the connecting mechanism associated with the lower end of the support frame.

In some embodiments, the support frame may include more than two frame members mounted to one another so as to be axially slidable relative to one another between the extended and retracted positions. For example, the support frame may include three, four or five frame members arranged in a telescopic arrangement.

According to a third aspect of the present invention, there is provided a method of installing an edge protection system, said method including:

extending at least two support frames as defined in the first aspect to the extended position such that the coupling mount of each support frame is positioned alongside or adjacent a roof edge of a building;

coupling the coupling mount of each said support frame to a portion of the building at or near the roof edge;

mounting a post of the edge protection system to a post mount of each said support frame; and spanning at least one rail between adjacently positioned posts.

The method may include one or more characteristics or features of the support frame and edge protection system as hereinbefore described.

Generally, the method may include an initial step of arranging the at least two support frames at spaced intervals at least partway about a perimeter of the building.

The method may include another preliminary step of connecting or coupling a base to a lower end of each support frame.

The extending may include an initial step of aligning the coupling mount of each support frame relative to the portion of the building to which it will be coupled.

In preferred embodiments, the extending may include applying torque to a threaded shaft actuating mechanism for moving each support frame to the extended position. The torque may be applied by a wrench, preferably an impact wrench.

Typically, each support frame may be extended until the coupling mount comes into engagement with the portion of the building, preferably a lower edge of the fascia or another like structural frame member, and the support frame is securely positioned in an upright position spanning between a support surface and a roof edge of the building.

Usually, the coupling may include aligning the pair of engagement members of the coupling mount of the support frame relative to the lower edge of the fascia or another like structural member adjacent the roof edge while the support frame is extended such that the lower edge is securely received between the engagement members.

In some embodiments, the mounting may include inserting a lower end of the post into a post mount of each support frame.

In other embodiments, the mounting may include aligning and engaging a lower end of the post over a post mounting protrusion extending upwards from each support frame.

Typically, the spanning may include extending the at least one rail between adjacently positioned posts and coupling the rail to each post.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows.

DETAILED DESCRIPTION

Figure 1:
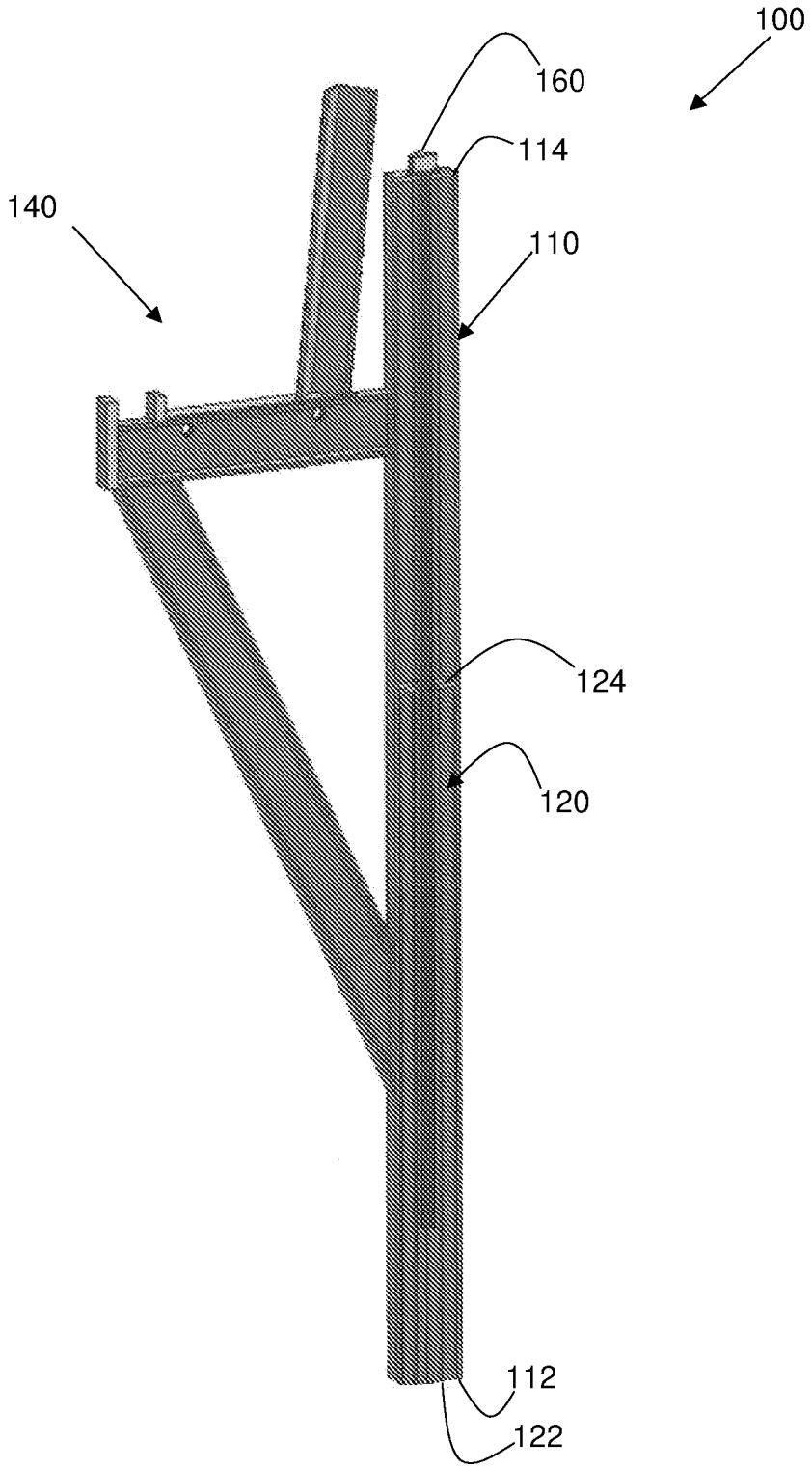
FIG. 1 is a sectional perspective view of a support frame for use with an edge protection system according to an embodiment of the present invention.

FIG. 1 shows a support frame (100) according to an embodiment of the present invention for use with an edge protection system in providing a temporary barrier around a roof edge of a building.

The support frame (100) includes: a first frame member (110) and a second frame member (120) mounted together so as to be axially slidable relative to one another between an extended position for locating a post of the edge protection system alongside a roof edge and a retracted position as shown; a coupling mount (140) extending from a side of the first frame member (110) for coupling to a fascia of a building and for receiving and supporting the post of the edge protection system in an upright position alongside the roof edge; and an actuating mechanism in the form of a threaded shaft (160) rotatably coupled to the first frame member (110) and upon which the second frame member (120) is threadingly mounted for movement therealong, by rotation of the threaded shaft (160), between the extended and retracted positions.

Referring to FIG. 1, the support frame (100) is generally formed from aluminium with the exception of the threaded shaft (160), which is formed from steel.

The frame members (110, 120), including the coupling mount (140), are formed from extrusions and are thus of tubular construction with substantially rectangular cross sections.

The frame members (110, 120) each include a pair of opposed ends, including a lower end (112, 122) and an opposed upper end (114, 124). Each frame members (110, 120) extending longitudinally in a linear direction between the opposed ends (112, 114, 122, 124).

Figure 2B:
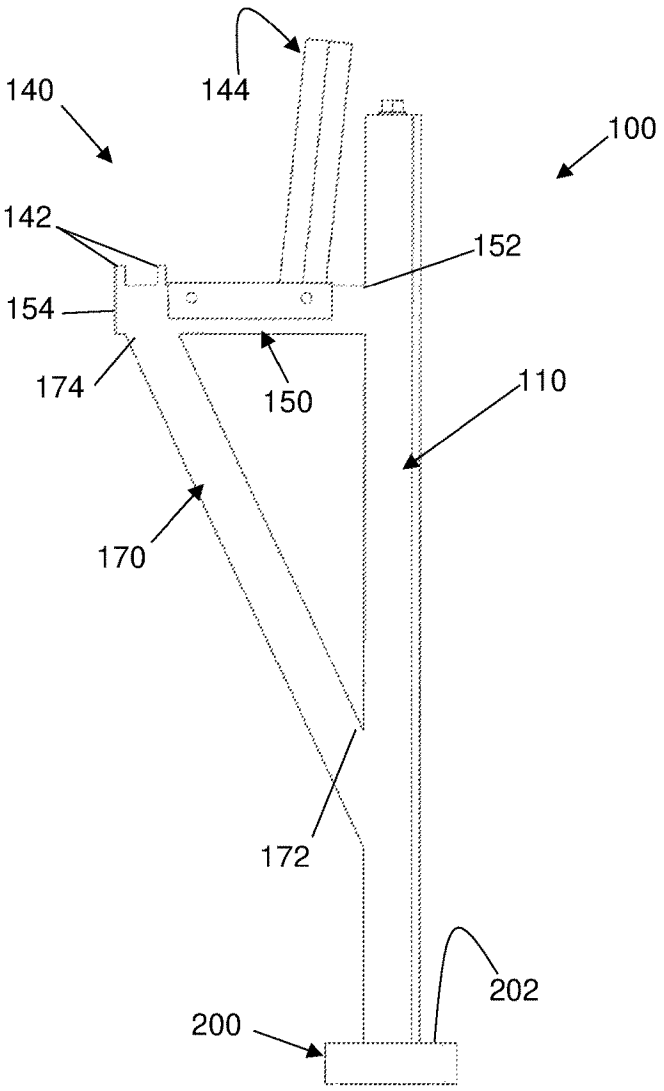
FIGS. 2A and 2B respectively show a sectional side view and a non-sectional side view of the support frame as shown in FIG. 1 coupled to a base.
Figure 2A:
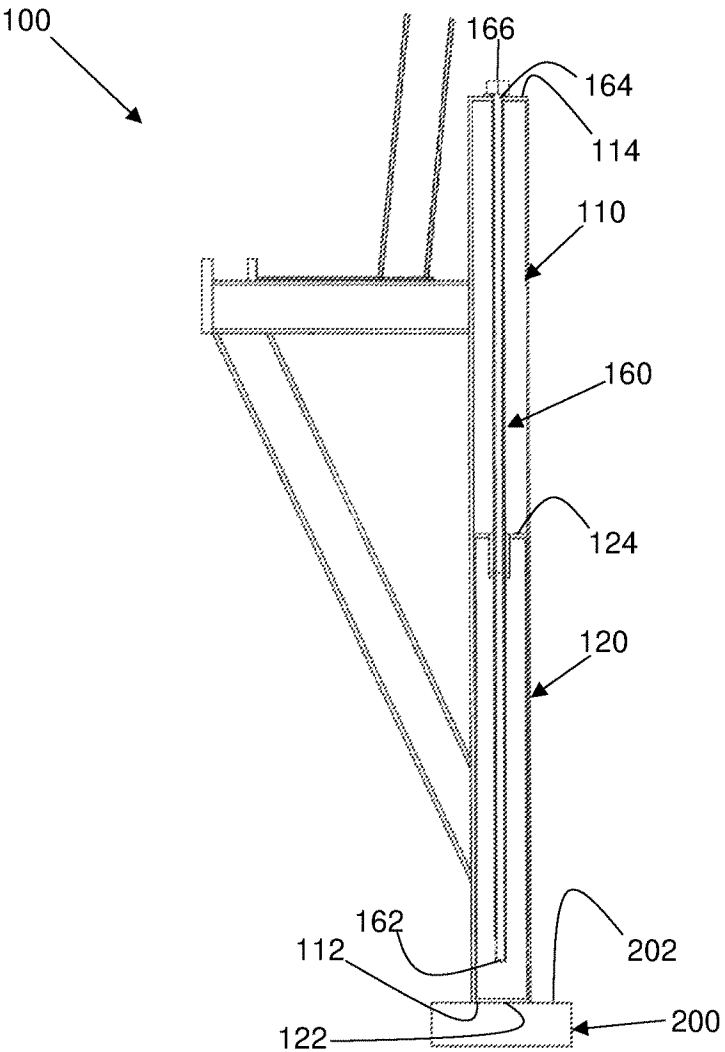

Referring briefly to FIG. 2A, the first and second frame members (110, 120) are mounted together in a telescopic arrangement in which the frame members (110, 120) are axially slidable relative to one another between the extended and retracted positions.

The second frame member (120) is at least partially received in the lower end (112) of the first frame member (110) and is axially slidable relative to the first frame member (110) between the extended positon (not shown) and the retracted position (shown).

As shown in the retracted position, the second frame member (120) is fully retracted within the first frame member (110).

Conversely, in the extended position, the second frame member (120) is almost fully extended from out of the lower end (112) of the first frame member (110). Generally, at least a portion of the upper end (124) of the second frame member (120) remains within the lower end (112) of the first frame member (110) when in the extended position so as not to compromise the structural integrity of the support frame (110).

Figure 3:
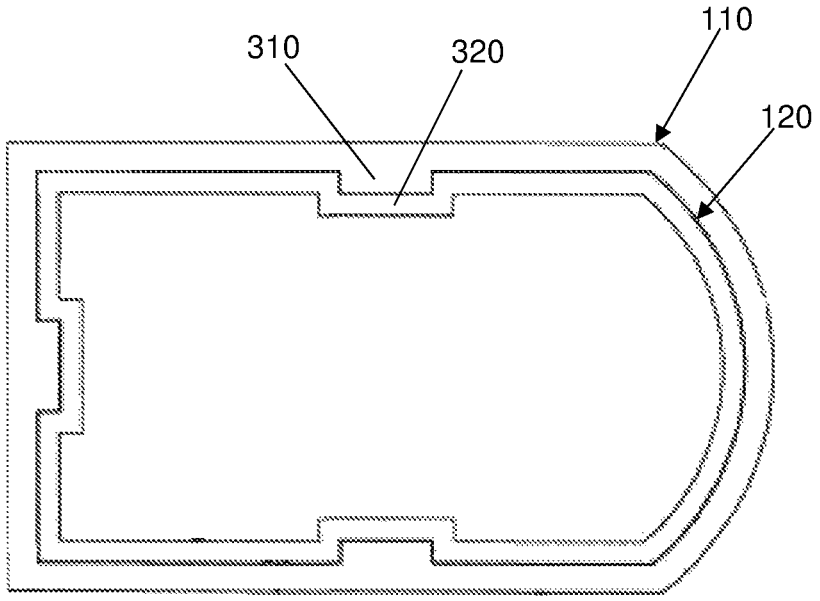
FIG. 3 is a cross-sectional view of a first frame member and a second frame member of the support frame as shown in FIGS. 1, 2A and 2B in a telescopic arrangement in which the frame members are axially slidable relative to one another.

Referring briefly to FIG. 3, in the telescopic arrangement, the first frame member (110) includes inwardly protruding rails or projections (310) extending longitudinally at least partway along an internal surface of one or more walls and the second frame member (120) includes corresponding grooves or channels (320) extending longitudinally at least partway along an outer surface of one or more corresponding walls and configured to engage with and at least partially receive the one or more inwardly protruding rails or projections (310) when the second frame member (120) is slidably received within the first frame member (110).

Referring back to FIG. 2A and as indicated above, the support frame (100) includes an actuating mechanism in the form of a threaded shaft (160) rotatably coupled to the first frame member (110) and upon which the second frame member (120) is threadingly mounted for movement therealong, by rotation of the threaded shaft (160), between the extended and retracted positions.

The threaded shaft (160) includes a pair of opposed ends, including a lower end (162) and an opposed upper end (164). The shaft (160) extends longitudinally between the opposed ends (162, 164) in a linear direction.

The threaded shaft (160) includes an external thread extending at least partially along a length of the shaft (160). The external thread has an Acme thread form.

As shown, the threaded shaft (160) is rotatably coupled to or near the upper end (114) of the first frame member (110) and extends along and through an internal passage of the first frame member (110) and at least partially along an internal passage of the second frame member (120).

The upper end (164) of the threaded shaft (160) is rotatably coupled to upper end (114) of the first frame member (110) such that the threaded shaft (160) is able to rotate about its longitudinal axis.

In the embodiment shown, the upper end (164) of the threaded shaft (160), which protrudes through an opening in the upper end (114) of the first frame member (110), has an enlarged shaft head (166) which is unable to pass through the opening and thereby secures the shaft (160) to the upper end (114) of the first frame member (110).

In use, the shaft head (166) has a hexagonal shape for engagement with a wrench or impact wrench for applying torque to the threaded shaft (160) and turning or rotating the shaft (160) relative to the first frame member (110).

As also shown, the second frame member (120) is threadingly mounted to the threaded shaft (160) for movement therealong by rotation of the threaded shaft (160) between the extended and retracted positions.

Like the first frame member (110), the second frame member (120) also includes an opening defined in its upper end (124) having an internal thread sized and shaped for receiving the threaded shaft (160) therethrough and for threadingly engaging with the external thread extending along the threaded shaft (160).

Referring to FIG. 2B and as indicated above, the support frame (100) includes the coupling mount (140) for coupling to a fascia of a building and for receiving and supporting a post of an edge protection system in an upright position alongside the roof edge.

The coupling mount (140) includes a pair of engagement members (142) and two coupling mount frame members (150, 170) that extend outwardly from a side of the first frame member (110) for positioning the pair of engagement members (142) for coupling to a fascia of a building.

The coupling mount frame members (150, 170) include a first mount frame member (150) that extends outwardly from an upper portion of a side of the first frame member (110) in a perpendicular direction relative to a longitudinal axis of the first frame member (110) and a second mount frame member (170) that extends at an angle between a lower portion of a side of the first frame member (110) and an outer portion of the first mount frame member (150) for supporting or bracing the first mount frame member (150).

Each coupling mount frame member (150, 170), like the first and second frame members (110, 120), are extrusions having a pair of opposed ends, including an inner end (152, 172) and an opposed outer end (154, 174). The respective inner ends (152, 172) of the frame members (150, 170) are permanently joined to a side of the first frame member (110) using conventional welding techniques.

The pair of engagement members (142) are arranged in a spaced arrangement near an outer end (154) of the first coupling mount frame member (150) for at least partially receiving and coupling with a lower edge portion of a fascia of the building received therebetween.

Each engagement member (142) is in the form of a projection or protrusion extending upwardly from and at least partially across an upper surface of the outer end (154) of the first coupling mount frame member (150). Each member (142) extends in a lateral direction perpendicular to a longitudinal axis of the frame member (150).

As also shown, the coupling mount (140) includes a post mount (144) for snugly receiving and supporting a post of an edge protection system in a substantially upright position. The post mount (144) is in the form of a socket located on an upper side of the first coupling mount frame member (150) near its inner end (152).

Best shown in both FIGS. 2A and 2B, the support frame further includes a base (200) for at least partially stabilising the support frame (100) in an upright position atop a support surface.

The base (200) is in the form of a rubber plate having a substantially rectangular shape.

The base (200) includes opposed surfaces extending substantially parallel to one another, including a lower surface and an opposed upper surface (202). The opposed surfaces are interconnected by opposing edges, including opposed end edges and opposed side edges.

The base (200) includes an opening defined in the upper surface (202) within which a lower end (122; visible only in FIG. 2A) of the second frame member (120; visible only in FIG. 2A) is received for coupling the base (200) to the support frame (100).

Figure 4:
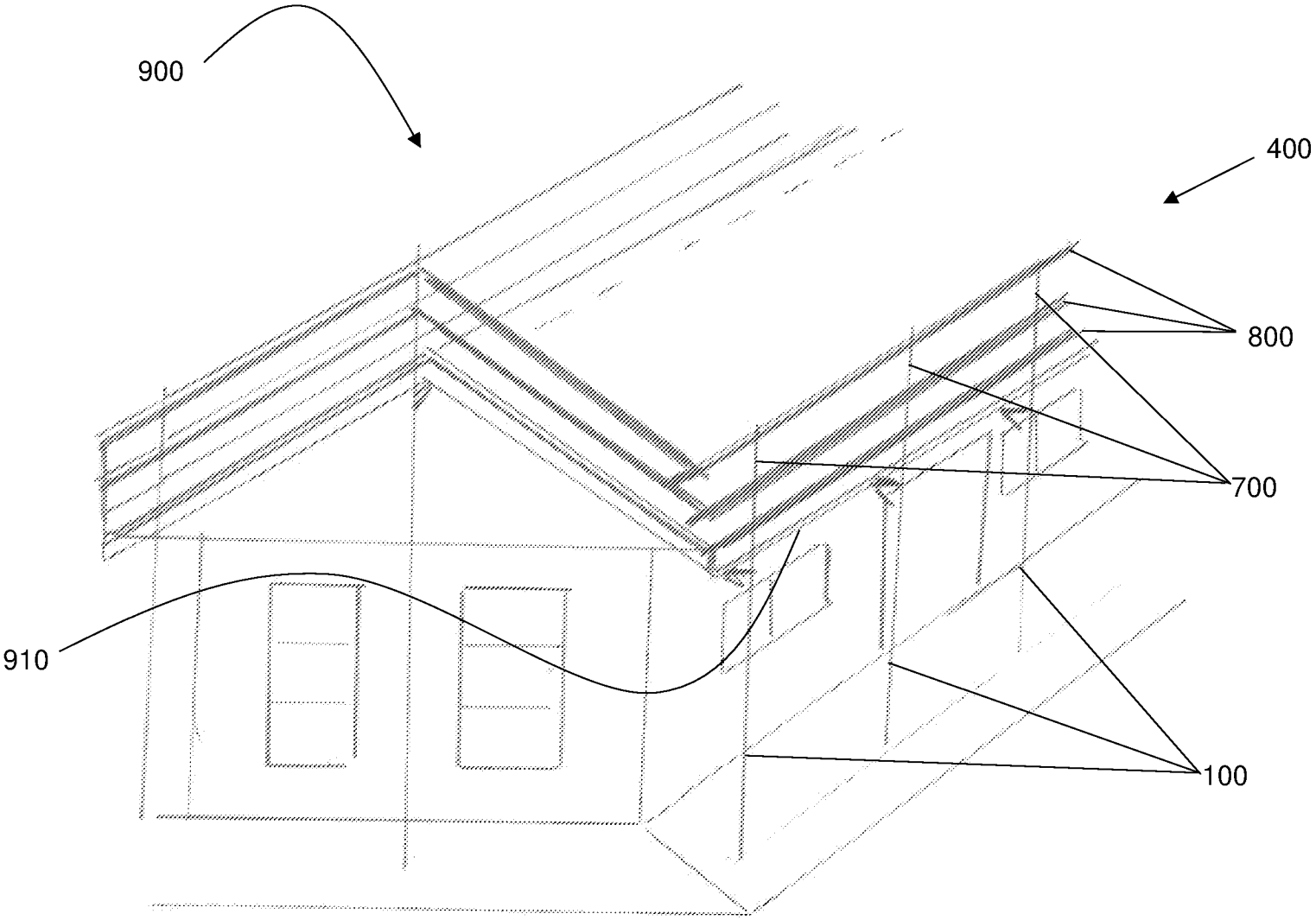
FIG. 4 is a perspective view of a building with an edge protection system according to an embodiment of the present invention installed around the building.

FIG. 4 shows an edge protection system (400) according to an embodiment of the present invention installed around a building (900).

The edge protection system (400) includes a plurality of the support frames (100), a plurality of posts (700) each mounted to a support frame (100) and a plurality of rails (800) arranged to span between and be coupled to the posts (700) to provide a temporary barrier about a roof edge (910) of the building (900).

As shown, the plurality of the support frames (100) arranged at spaced intervals around a perimeter of the building (900) and each is shown in the extended position extending between the support surface and the roof edge (910).

Each support frame (100) is coupled to the fascia of the building (900) as shown for supporting a post (700) of the edge protection system (400) in a substantially upright position. Each post (700) is mounted to the post mount (144; not visible) of the coupling mount (140; not visible) of each support frame (100).

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A support frame for an edge protection system, said frame comprising:

a first frame member and a second frame member mounted together so as to be axially slidable relative to one another between an extended position for spanning between a support surface and a roof edge for locating a post of the edge protection system alongside the roof edge of a building and a retracted position;

a coupling mount comprising at least one coupling mount frame member having an inner end and an opposed outer end and extending outwardly from a side of an uppermost said frame member of either the first frame member or the second frame member, a pair of engagement members arranged on the outer end of the at least one coupling mount frame member for engaging with a portion of the building, and a post mount comprising a socket located on an upper side of the at least one coupling mount frame member at or near the inner end for snugly receiving and supporting the post in an upright position alongside the roof edge of the building; and a threaded shaft actuating mechanism comprising a threaded shaft rotatably coupled to the first frame member and upon which the second frame member is mounted for movement therealong by rotation of the threaded shaft between the extended position and the retracted position.

2. The frame of claim 1, wherein the first frame member is an uppermost frame member and the second frame member is a lowermost frame member when mounted together and in an upright position.

3. The frame of claim 1, wherein the second frame member comprises a shaped groove or channel extending linearly at least partially along its length and the first frame member is slidably connected to the shaped groove or channel.

4. The frame of claim 3, wherein the first frame member further comprises at least one retaining member configured to be retainable and slidable within the shaped groove or channel such that the first frame member is slidable along the shaped groove or channel but is prevented from separating away from the shaped groove or channel.

5. The frame of claim 4, wherein the at least one retaining member comprises an enlarged head configured to engage and be retained within the shaped groove or channel.

6. The frame of claim 1, wherein the first frame member and the second frame member are mounted together in a telescopic arrangement in which one of the first frame member and the second frame member is at least partially received within an end of the other of the first frame member and the second frame member so as to be axially slidable relative to the other of the first frame member and the second frame member.

7. The frame of claim 6, wherein the second frame member is at least partially received in a lower end of the first frame member and is axially slidable relative to the first frame member between the extended position and the retracted position.

8. The frame of claim 1, wherein the threaded shaft is rotatably coupled to or near an upper end of the first frame member and extends along and through an internal passage of the first frame member and at least partially along an internal passage of the second frame member.

9. The frame of claim 8, wherein the threaded shaft comprises an enlarged head that protrudes from an upper end of the first frame member.

10. The frame of claim 9, wherein the enlarged head is configured for engaging with a tool for applying torque to the threaded shaft and turning or rotating the shaft relative to the first frame member and the second frame member.

11. The frame of claim 1, wherein the second frame member has a closed upper end comprising a central opening for receiving the threaded shaft therethrough and for threadingly engaging with the threaded shaft.

12. The frame of claim 1, wherein the second frame member comprises a screw mounting portion configured to receive and threadingly engage with the threaded shaft, said screw mounting portion being located within an internal passage of the second frame member.

13. The frame of claim 12, wherein the coupling mount further comprises a second coupling mount frame member extending between the first frame member and the coupling mount frame member for supporting or bracing the coupling mount frame member.

14. The frame of claim 1, wherein the coupling mount is configured to couple with a fascia, a soffit beam, a rafter, or a truss extending about a roof edge of the building.

15. The frame of claim 1, wherein the coupling mount comprises a flanged portion configured to be fastened to a portion of the building, said flanged portion comprising one or more openings each configured to receive a mechanical fastener therethrough for fastening the flanged portion to the portion of the building.

16. The frame of claim 1, wherein the pair of engagement members are arranged in a spaced arrangement on the outer end of the coupling mount frame member for at least partially receiving and coupling with the portion of the building received therebetween.

17. The frame of claim 1, wherein each of said engagement members comprises a projection extending or protruding upwardly from and at least partially across an upper surface of the coupling mount frame member in a lateral direction perpendicular to a longitudinal axis of the coupling mount frame member.

18. A method of installing an edge protection system, said method comprising:

extending at least two support frames as defined in claim 1 to the extended position such that the coupling mount of each support frame is positioned alongside or adjacent a roof edge of a building;

coupling the coupling mount of each said support frame to a portion of the building at or near the roof edge;

mounting a post of the edge protection system to a post mount of each said support frame; and spanning at least one rail between adjacently positioned posts.

19. The method of claim 18, wherein the extending comprises applying torque to the threaded shaft actuating mechanism for moving each support frame to the extended position.

* * * * *